US011388991B1

(12) United States Patent
Poniatowski

(10) Patent No.: US 11,388,991 B1
(45) **Date of Patent: *Jul. 19, 2022**

(54) HEIGHT ADJUSTABLE DESKTOP

(71) Applicant: Nathan Mark Poniatowski, Denver, CO (US)

(72) Inventor: Nathan Mark Poniatowski, Denver, CO (US)

(73) Assignee: Office Kick, Inc., Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/118,749

(22) Filed: Dec. 11, 2020

Related U.S. Application Data

(63) Continuation of application No. 16/029,399, filed on Jul. 6, 2018, now Pat. No. 10,893,748.

(60) Provisional application No. 62/546,635, filed on Aug. 17, 2017, provisional application No. 62/530,141, filed on Jul. 8, 2017.

(51) Int. Cl.

| | |
|---|---|
| ***A47B 21/02*** | (2006.01) |
| ***A47B 21/03*** | (2006.01) |
| ***A47B 21/06*** | (2006.01) |
| ***A47B 9/16*** | (2006.01) |

(52) U.S. Cl.
CPC ..... *A47B 21/02* (2013.01); *A47B 9/16* (2013.01); *A47B 21/0314* (2013.01); *A47B 21/06* (2013.01); *A47B 2021/0335* (2013.01); *A47B 2021/066* (2013.01); *A47B 2200/0046* (2013.01)

(58) Field of Classification Search
CPC ..... A47B 9/16; A47B 21/02; A47B 21/0314; A47B 2021/0364; A47B 2021/066; A47B 2200/0046
USPC ..... 108/145, 147, 50.01, 50.02; 254/122, 254/124
See application file for complete search history.

(56) References Cited

U.S. PATENT DOCUMENTS

| | | | |
|---|---|---|---|
| 1,318,564 | A | 10/1919 | Jenkins |
| 2,843,418 | A | 7/1958 | Gray |
| 2,937,003 | A | 5/1960 | Croll |
| 3,295,800 | A | 1/1967 | Karl-Erik et al. |

(Continued)

FOREIGN PATENT DOCUMENTS

| | | |
|---|---|---|
| CN | 1142343 A | 2/1997 |
| CN | 2781893 | 5/2006 |

(Continued)

OTHER PUBLICATIONS

Adjustable Desk: Varidesk, http://www.varidesk.com, United States of America, Mar. 30, 2013.

(Continued)

*Primary Examiner* — Jose V Chen
(74) *Attorney, Agent, or Firm* — Lund IP, PLLC

(57) ABSTRACT

A height adjustable desktop includes an upper work surface platform, and a base platform, which configured to rest on an existing desk, platform, surface, or table. The height adjustable desktop further includes a height adjustment mechanism that includes two sets of two arms that connect at pivot points along their lengths so that the arms configured to move in a scissoring motion to raise and lower the upper work surface platform. The height adjustable desktop also includes two actuators that apply a force to the two sets of two arms, the actuators each containing feedback sensors that provide data regarding the current position and distance each actuator has extended, retracted or moved.

20 Claims, 18 Drawing Sheets

(56) References Cited

U.S. PATENT DOCUMENTS

| | | | |
|---|---|---|---|
| 3,823,915 | A | 7/1974 | Koehler |
| 3,826,457 | A | 7/1974 | Huot de Longchamp |
| 4,221,280 | A | 9/1980 | Richards |
| 4,448,386 | A | 5/1984 | Moorhouse et al. |
| 4,449,262 | A | 5/1984 | Jahsman et al. |
| 4,549,720 | A | 10/1985 | Bergenwall |
| 4,558,648 | A | 12/1985 | Franklin et al. |
| 4,577,821 | A | 3/1986 | Edmo et al. |
| 4,625,657 | A | 12/1986 | Little et al. |
| 4,640,488 | A | 2/1987 | Sakamoto |
| 4,659,052 | A | 4/1987 | Nagata |
| 4,702,454 | A | 10/1987 | Izumida |
| 4,709,972 | A | 12/1987 | LaBudde et al. |
| 4,717,112 | A | 1/1988 | Pirkle |
| 4,741,512 | A | 5/1988 | Elkuch et al. |
| 4,753,419 | A | 6/1988 | Johansson |
| 4,826,123 | A | 5/1989 | Hannah et al. |
| 4,843,978 | A | 7/1989 | Schmidt et al. |
| D302,893 | S | 8/1989 | Wakefield |
| 4,941,641 | A | 7/1990 | Granzow et al. |
| 4,967,672 | A | 11/1990 | Leather |
| 4,995,130 | A | 2/1991 | Hahn et al. |
| 5,037,163 | A | 8/1991 | Hatcher |
| 5,048,784 | A | 9/1991 | Schwartz et al. |
| 5,211,367 | A | 5/1993 | Musculus |
| 5,251,864 | A | 10/1993 | Itou |
| 5,257,767 | A | 11/1993 | McConnell |
| 5,294,087 | A | 3/1994 | Drabczyk et al. |
| 5,400,720 | A | 3/1995 | Stevens |
| 5,588,377 | A | 12/1996 | Fahmian |
| 5,626,323 | A | 5/1997 | Lechman et al. |
| 5,722,513 | A | 3/1998 | Rowan et al. |
| 5,765,797 | A | 6/1998 | Greene et al. |
| 5,829,948 | A | 11/1998 | Becklund |
| 5,836,562 | A | 11/1998 | Danzyger et al. |
| 5,926,876 | A | 7/1999 | Haigh et al. |
| 5,957,426 | A | 9/1999 | Brodersen |
| 6,076,785 | A | 6/2000 | Oddsen, Jr. |
| 6,098,961 | A | 8/2000 | Gionet |
| 6,148,739 | A | 11/2000 | Martin |
| 6,176,456 | B1 | 1/2001 | Wisniewski |
| 6,179,261 | B1 | 1/2001 | Lin |
| 6,269,753 | B1 | 8/2001 | Roddan |
| 6,273,382 | B1 | 8/2001 | Pemberton |
| 6,488,248 | B1 | 12/2002 | Watt et al. |
| 6,516,478 | B2 | 2/2003 | Cook et al. |
| 6,533,229 | B1 | 3/2003 | Hung |
| 6,533,479 | B2 | 3/2003 | Kochanski |
| 6,672,430 | B2 | 1/2004 | Boucher et al. |
| 6,701,853 | B1 | 3/2004 | Hwang |
| 6,702,372 | B2 | 3/2004 | Tholkes et al. |
| 6,722,618 | B1 | 4/2004 | Wu |
| 6,742,768 | B2 | 6/2004 | Alba |
| 6,792,876 | B2 | 9/2004 | Lin |
| 6,857,493 | B2 | 2/2005 | Shupp et al. |
| 6,938,866 | B2 | 9/2005 | Kirchhoff |
| 7,048,236 | B2 | 5/2006 | Benden et al. |
| 7,188,813 | B2 | 3/2007 | Kollar |
| 7,204,193 | B2 | 4/2007 | Scherrer et al. |
| 7,207,629 | B2 | 4/2007 | Goetz et al. |
| 7,246,784 | B1 | 7/2007 | Lopez |
| 7,575,205 | B2 | 8/2009 | Kirchhoff |
| 7,677,518 | B2 | 3/2010 | Chouinard et al. |
| 7,841,570 | B2 | 11/2010 | Mileos et al. |
| 7,845,665 | B2 | 12/2010 | Borisoff |
| 7,946,551 | B1 | 5/2011 | Cvek |
| 7,950,338 | B2 | 5/2011 | Smed |
| 8,015,638 | B2 | 9/2011 | Shimada et al. |
| 8,132,518 | B2 | 3/2012 | Lee et al. |
| 8,303,062 | B2 | 11/2012 | Zanelli |
| 8,469,152 | B2 | 6/2013 | Olsen et al. |
| 8,490,933 | B2 | 7/2013 | Papic et al. |
| 8,544,391 | B2 | 10/2013 | Knox et al. |
| 8,671,853 | B2 | 3/2014 | Flaherty |
| 8,684,339 | B2 | 4/2014 | Demi et al. |
| 8,931,750 | B2 | 1/2015 | Kohl et al. |
| 8,950,343 | B2 | 2/2015 | Huang |
| 9,049,923 | B1 | 6/2015 | Delagey et al. |
| 9,055,810 | B2 | 6/2015 | Flaherty |
| 9,232,855 | B2 | 1/2016 | Ergun et al. |
| 9,326,598 | B1 | 5/2016 | West et al. |
| 9,480,332 | B2 | 11/2016 | Han |
| 9,504,316 | B1 | 11/2016 | Streicher et al. |
| 9,554,644 | B2 | 1/2017 | Flaherty et al. |
| 9,668,572 | B2 | 6/2017 | Ergun et al. |
| 9,681,746 | B1 | 6/2017 | Chen |
| 9,809,136 | B2 | 11/2017 | Haller et al. |
| 9,815,672 | B2 | 11/2017 | Baudermann |
| 9,854,904 | B2 | 1/2018 | Getz |
| 9,955,780 | B2 | 5/2018 | Koch |
| 9,981,571 | B2 | 5/2018 | Garing |
| 9,993,068 | B2 | 6/2018 | Lin et al. |
| 10,018,298 | B2 | 7/2018 | Goldish et al. |
| 10,023,355 | B2 | 7/2018 | Taylor et al. |
| D830,739 | S | 10/2018 | Min |
| 10,114,352 | B2 | 10/2018 | Matlin |
| 10,123,613 | B2 | 11/2018 | Hall et al. |
| D845,037 | S | 4/2019 | Min |
| 10,244,861 | B1 | 4/2019 | Poniatowski |
| 10,258,148 | B1 | 4/2019 | Donner et al. |
| 10,258,149 | B2 | 4/2019 | Zhong |
| 10,264,877 | B2 | 4/2019 | Hu et al. |
| 10,306,977 | B2 | 6/2019 | Wong |
| D854,775 | S | 7/2019 | Chang et al. |
| 10,413,055 | B2 | 9/2019 | Laudadio |
| D870,490 | S | 12/2019 | Hu |
| 10,499,730 | B2 | 12/2019 | Kim et al. |
| 10,517,390 | B2 | 12/2019 | Xiang et al. |
| 10,524,565 | B2 | 1/2020 | Ergun et al. |
| 10,542,817 | B2 | 1/2020 | Swartz et al. |
| 10,544,019 | B2 | 1/2020 | Kochie et al. |
| 10,568,416 | B1 | 2/2020 | Poniatowski |
| 10,575,630 | B1 | 3/2020 | Poniatowski |
| D901,959 | S | 11/2020 | Chang |
| 10,869,549 | B2 | 12/2020 | Xiang et al. |
| 10,893,748 | B1 | 1/2021 | Poniatowski |
| 11,083,282 | B1 | 8/2021 | Liu |
| 11,134,773 | B1 | 10/2021 | Poniatowski |
| 11,134,774 | B1 | 10/2021 | Poniatowski |
| 11,140,977 | B1 | 10/2021 | Poniatowski |
| 11,147,366 | B1 | 10/2021 | Poniatowski |
| 11,160,367 | B1 | 11/2021 | Poniatowski |
| 2003/0042380 | A1 | 3/2003 | Hagglund et al. |
| 2003/0213415 | A1 | 11/2003 | Ross et al. |
| 2005/0120922 | A1 | 6/2005 | Brooks |
| 2007/0001077 | A1 | 1/2007 | Kirchhoff |
| 2007/0080564 | A1 | 4/2007 | Chen |
| 2007/0266912 | A1 | 11/2007 | Swain |
| 2008/0000393 | A1 | 1/2008 | Wilson et al. |
| 2009/0145336 | A1 | 6/2009 | Kenny |
| 2010/0242174 | A1 | 9/2010 | Morrison, Sr. et al. |
| 2012/0097822 | A1 | 4/2012 | Hammarskiöld |
| 2012/0188302 | A1 | 7/2012 | Zanelli |
| 2013/0193392 | A1 | 8/2013 | McGinn |
| 2014/0144352 | A1 | 5/2014 | Roberts |
| 2015/0028787 | A1 | 1/2015 | Sekine et al. |
| 2015/0216296 | A1 | 8/2015 | Mitchell |
| 2015/0289641 | A1 | 10/2015 | Ergun et al. |
| 2016/0249737 | A1 | 9/2016 | Han |
| 2016/0338486 | A1 | 11/2016 | Martin |
| 2016/0353880 | A1 | 12/2016 | Sigal et al. |
| 2017/0071332 | A1 | 3/2017 | Herring et al. |
| 2017/0196351 | A1 | 7/2017 | Failing |
| 2017/0354245 | A1 | 12/2017 | Martin et al. |
| 2018/0125227 | A1 | 5/2018 | Xiang et al. |
| 2018/0177289 | A1 | 6/2018 | Chen |
| 2018/0213929 | A1 | 8/2018 | Ergun et al. |
| 2018/0279770 | A1 | 10/2018 | Crowe et al. |
| 2019/0110588 | A1 | 4/2019 | Wong |
| 2019/0183239 | A1 | 6/2019 | Semmelrath et al. |
| 2019/0269237 | A1 | 9/2019 | Zhu |

(56) References Cited

U.S. PATENT DOCUMENTS

| | | | |
|---|---|---|---|
| 2020/0029685 | A1 | 1/2020 | Du et al. |
| 2020/0107633 | A1 | 4/2020 | Kang |

FOREIGN PATENT DOCUMENTS

| | | | |
|---|---|---|---|
| CN | 102599728 | | 7/2012 |
| CN | 202681005 | U | 1/2013 |
| CN | 202681013 | | 1/2013 |
| CN | 202874336 | | 4/2013 |
| CN | 203333240 | U | 12/2013 |
| CN | 203934825 | U | 11/2014 |
| CN | 107048694 | | 8/2017 |
| CN | 107048695 | A | 8/2017 |
| CN | 107212587 | A | 9/2017 |
| CN | 107744256 | A | 3/2018 |
| CN | 107756350 | A | 3/2018 |
| CN | 107912868 | | 4/2018 |
| CN | 109008216 | | 12/2018 |
| CN | 208403596 | U | 1/2019 |
| CN | 110840072 | | 2/2020 |
| DE | 2851555 | | 11/1983 |
| DE | 8606822 | | 8/1991 |
| DE | 4424564 | | 1/1996 |
| DE | 29515642 | | 1/1996 |
| DE | 19526596 | | 1/1997 |
| DE | 102013008020 | A1 | 11/2014 |
| DE | 202016101126 | | 6/2016 |
| EP | 0613852 | | 11/1997 |
| EP | 2745733 | | 6/2014 |
| EP | 3092918 | | 11/2016 |
| FR | 2637165 | | 4/1990 |
| FR | 2894794 | | 6/2007 |
| FR | 3028735 | | 5/2016 |
| JP | 5861051 | | 4/1983 |
| JP | 2012030022 | A | 2/2012 |
| JP | 2017045506 | A | 3/2017 |
| KR | 100802663 | B1 | 2/2008 |
| KR | 20140004886 | | 9/2014 |
| KR | 20160074221 | A | 6/2016 |
| KR | 101635611 | | 7/2016 |
| KR | 101969133 | B1 | 8/2019 |
| NL | 1011051 | | 7/2000 |
| WO | 1991017906 | | 11/1991 |
| WO | 2017045506 | A1 | 3/2017 |
| WO | 2018093007 | A1 | 5/2018 |
| WO | 2019001506 | | 1/2019 |
| WO | 2019001507 | | 1/2019 |

OTHER PUBLICATIONS

Ergotron, http://www.ergotron.com, United States of America, Sep. 29, 2014.

Levine, James A. "Sitting down is KILLING you! Heart disease, obesity, depression and crumbling bones—a terrifying new book by a top doctor reveals they are all linked to the hours we spend in chairs" Daily Mail Online, Jul. 26, 2014, 9 pages [online], [retrieved on Jun. 30, 2017]. Retrieved from the Internet at: http://www.dailymail.co.uk/news/article-2706317.

HEIGHT ADJUSTABLE DESKTOP

This application is a continuation application of U.S. patent application Ser. No. 16/029,399, titled HEIGHT ADJUSTABLE DESKTOP, filed Jul. 6, 2018, which claimed the benefit of U.S. Provisional Application No. 62/530,141, titled KEYBOARD TRAY THAT ADJUSTS HORIZONTALLY & VERTICALLY, filed on Jul. 8, 2017, and further claimed the benefit of U.S. Provisional Application No. 62/546,635, titled HEIGHT ADJUSTABLE DESKTOP, filed on Aug. 17, 2017. The entire contents of each of these applications are incorporated by reference herein.

TECHNICAL FIELD

This disclosure relates to an adjustable desktop surface that adjusts up and down.

BACKGROUND

In recent years studies have been conducted to show the health benefits of standing more. There are many different types of work surfaces available today. Most of these are stationary, in that they do not adjust in height. In recent years, entire desks that adjust in height have become more common. Most people already have a stationary desk, so purchasing an entire new desk may be unreasonable for some.

BRIEF SUMMARY

This disclosure includes height adjustable desktops including an upper platform that acts as the work surface, a base platform that is placed on an existing surface, such as a desktop, and a height adjustment mechanism. The height adjustment mechanism allows the work surface to raise and lower to the desired height of the operator.

In one example, this disclosure is directed to a height adjustable desktop comprising an upper work surface platform, and a base platform, which configured to rest on an existing desk, platform, surface, or table. The height adjustable desktop further comprises a height adjustment mechanism that includes two sets of two arms that connect at pivot points along their lengths so that the arms configured to move in a scissoring motion to raise and lower the upper work surface platform. The height adjustable desktop also comprises two actuators that apply a force to the two sets of two arms, the actuators each containing feedback sensors that provide data regarding the current position and distance each actuator has extended, retracted or moved.

In a further example, this disclosure is directed to a method comprising receiving an input signal to raise or lower an upper work surface platform of a height adjustable desktop; for each of two actuators, receiving data regarding the current position and distance each actuator has extended, retracted or moved; and sending control signals to the two actuators corresponding to the input signal to raise or lower the upper work surface platform, the control signals accounting for the data regarding the current position and distance each actuator has extended, retracted or moved such that the two actuators extend or contract in unison.

In another example, this disclosure is directed to a non-transitory computer readable medium comprising computer readable instructions for causing a processor to: receive an input signal to raise or lower an upper work surface platform of a height adjustable desktop; for each of two actuators, receive data regarding the current position and distance each actuator has extended, retracted or moved; and send control signals to the two actuators corresponding to the input signal to raise or lower the upper work surface platform, the control signals accounting for the data regarding the current position and distance each actuator has extended, retracted or moved such that the two actuators extend or contract in unison.

BRIEF DESCRIPTION OF THE DRAWINGS

FIG. 5B is a perspective view of an example height adjustable desktop in a lowered state sitting on a table or desk, where the optional keyboard tray is in an out and lowered position, so that the keyboard tray rests below the table or surface the height adjustable desktop rests on.

DETAILED DESCRIPTION

Figure 1A:
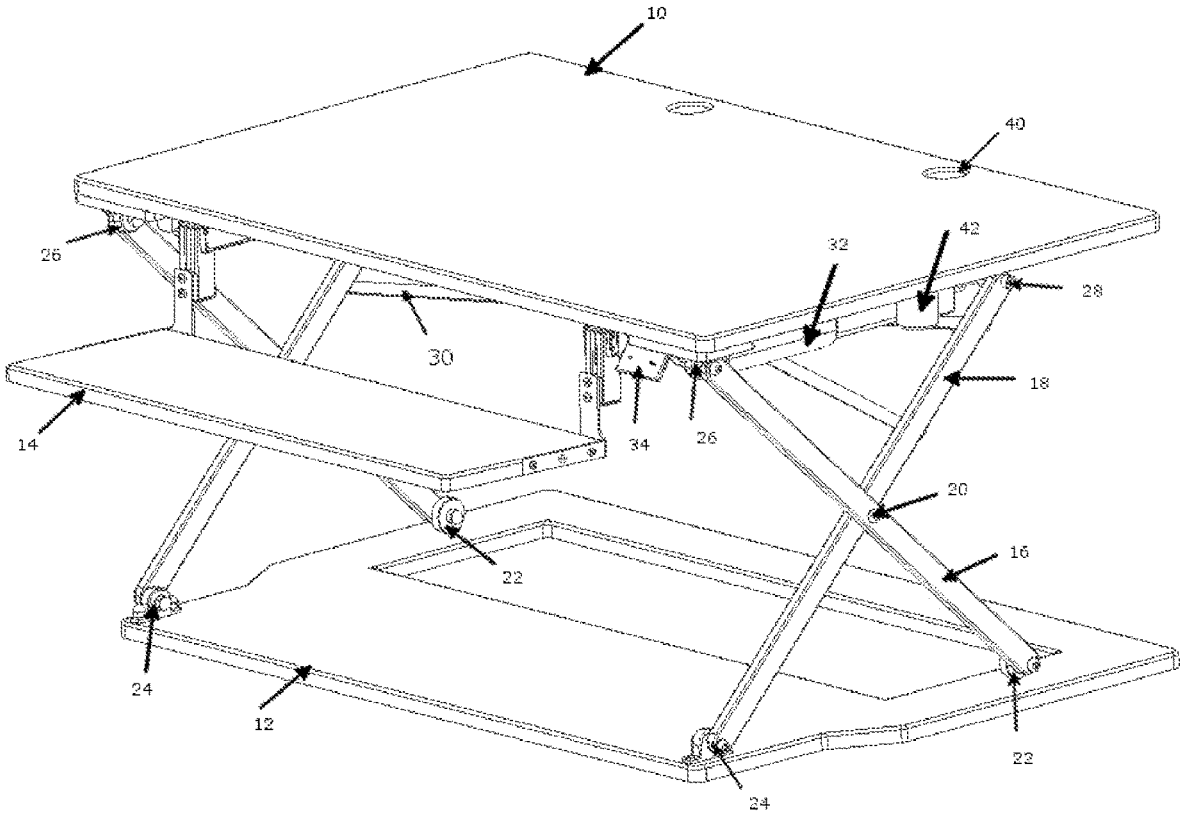
FIG. 1A is an example height adjustable desktop in an almost fully raised position with keyboard tray out and down.
Figure 1B:
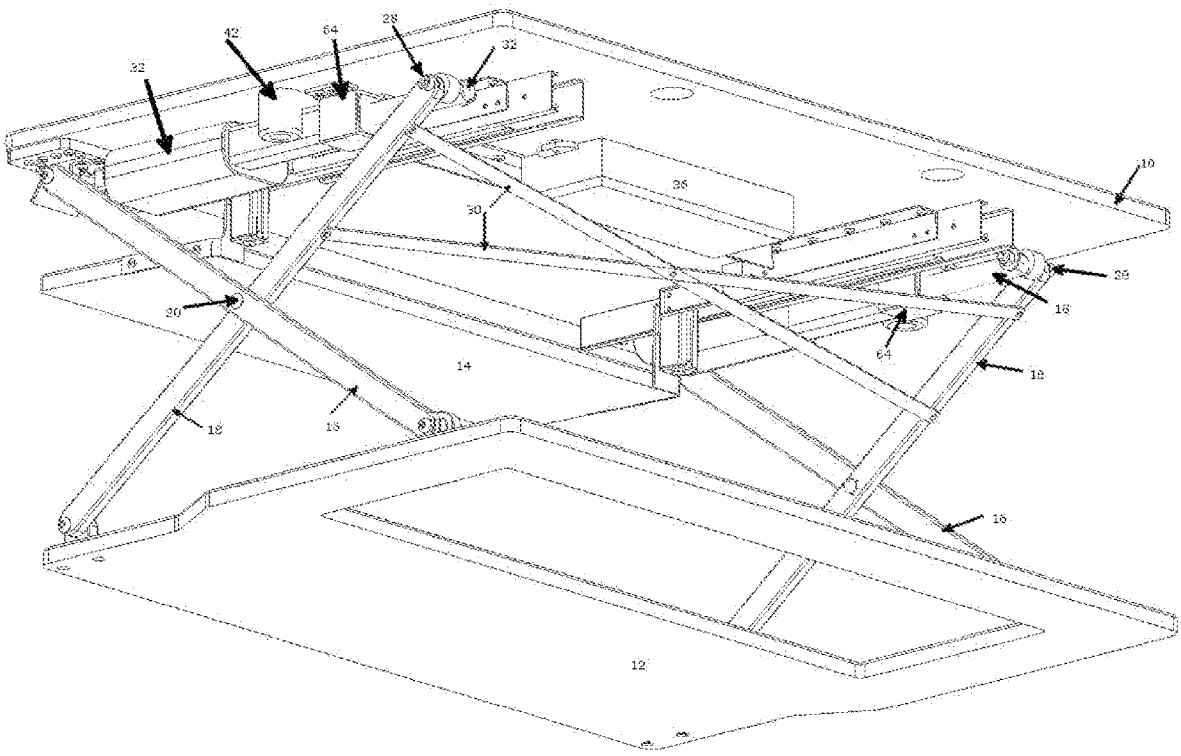
FIG. 1B is a perspective view, showing the example height adjustable desktop from a different angle in a partially raised position.
Figure 1C:
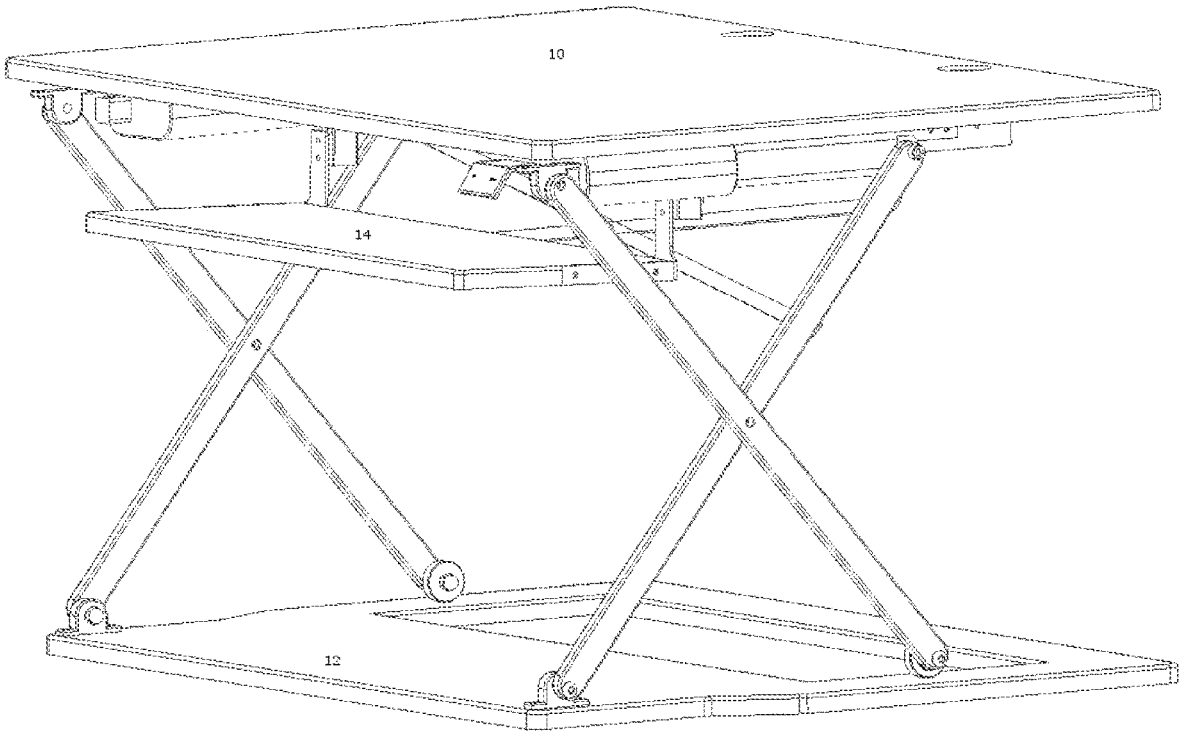
FIG. 1C is a perspective view, showing the example height adjustable desktop in an almost fully raised position with a keyboard tray in and down.
Figure 1D:
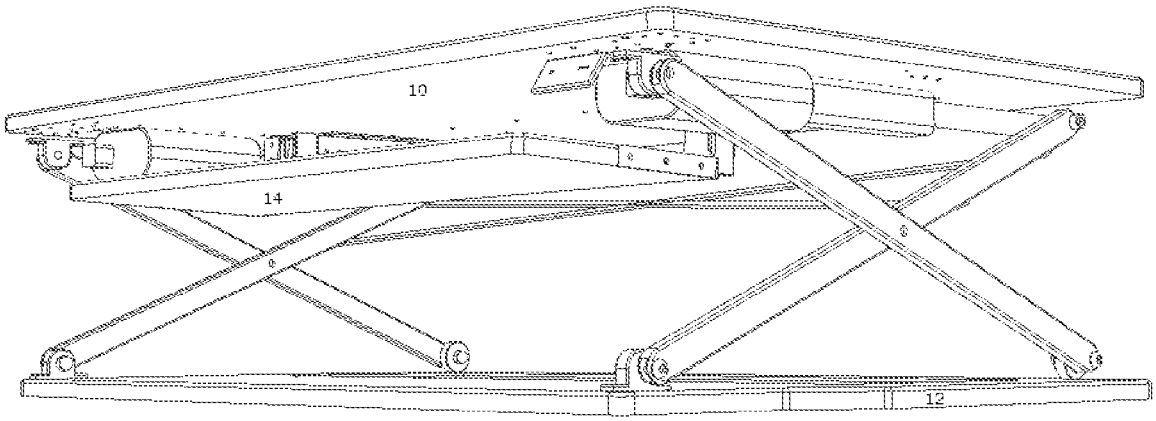
FIG. 1D is a perspective view, showing the example height adjustable desktop in a partially raised position with the keyboard tray in and up.
Figure 1E:
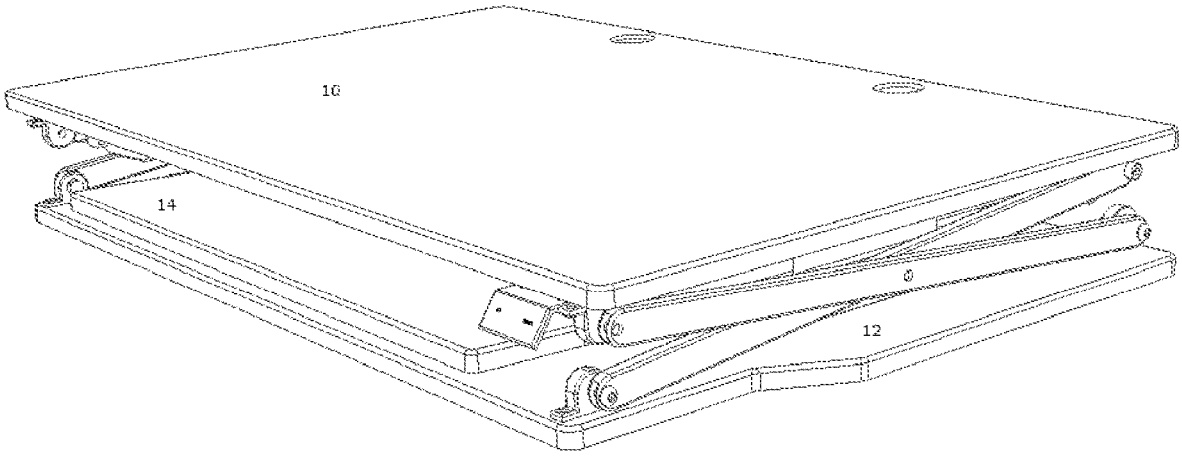
FIG. 1E is a perspective view, showing the example height adjustable desktop in a lowered position with the keyboard tray in and up.

A variety of techniques are disclosed herein with respect to height adjustable desktops, including machines, articles of manufacture and associated processes. While a number of specific examples are descripted, these specific examples do not limit the scope and applicability of the disclosed techniques. It should be understood that other terminology, parts, components, and layouts could be used that would still embody the spirit of this disclosure. Individuals skilled in the art will recognize that embodiments described below have suitable alternatives. It is also noted that embodiments are not limited to specific construction materials, and that various suitable materials exist for the elements of examples disclosed herein.

The disclosure includes a device and a method to raise and lower an upper work surface platform that is part of the device. An exemplary use of the upper work surface platform is as a desk, which can be moved to a desired vertical position. For example, the upper work surface platform can hold objects such as a laptop, monitor, tablet, keyboard, mouse, and other desk items such as a stapler. The height adjustable desktop may also include ancillary devices such as a monitor raiser, an external keyboard holder, mouse holder, cable organizer, charging platforms, data ports, power ports or other devices. In some examples, the upper work surface platform raises vertically without protruding out along the horizontal plane, keeping a user from having to step backward to use the work surface when it is in a raised position. The height adjustable desktop allows the user to utilize the work surface at various heights. While the embodiments and description herein suggest the height adjustable desktop is used for supporting typical desktop objects, but the scope of the disclosure is intended to support other objects and to be used in other applications.

In some examples, a height adjustable desktop includes at least two sets of arms as part of a height adjustment mechanism that utilize a scissor motion to move the work surface up and down. Each set of the arms have a rolling or sliding device, such as a wheel, bearing, track or slider attached to one end of one of the arms in each set of arms, where the rolling device or sliding device allows motion of one end of the arms as it rests on the base surface of the height adjustable desktop.

In some examples, the height adjustable desktop's height adjustment mechanism(s) includes actuators and a control box to provide power and syncing intelligence for height change of the upper work surface platform. The actuators include feedback sensors. The control box works with the sensors in the actuators or driving motors to ensure that they are moving in unison, keeping the upper worksurface substantially level and parallel with the surface the height adjustable desktop rests on. In other examples, the actuators or driving motors may move in unison to locate the upper worksurface to a desired position nonparallel with the surface the height adjustable desktop rests on.

In some examples, the height adjustable desktop's height adjustment mechanism lifts the work surface parallel to the surface the disclosure sits on, without moving back and forth or left to right; keeping the individual using the device from having to move backward to use the work surface when it is in a raised position.

In some examples, the height adjustable desktop can include a keyboard platform (tray) that can be adjusted both vertically and horizontally, to allow the user to move the keyboard tray to a desired and/or ergonomic position.

In some examples, the keyboard tray (platform) includes at least one adjustment mechanism that utilizes a track, rail or other component to guide the platform up and down, and at least one track, rail, or other component to guide the platform in a horizontal motion. The keyboard tray's position adjustment mechanism allows the user to lift or lower the platform with respect to the surface the height adjustable desktop is attached to, as well as slide out toward the user in a horizontal motion; allowing the individual using the device to position the keyboard platform to the desired horizontal and vertical position.

In some examples, the height adjustable desktop may provide one or more advantages. For example, the height adjustable desktop is directed to help individuals from sitting or standing for prolonged periods of time while they work. Studies have shown that sitting or standing for long periods of time can be detrimental to one's health. As another example, the height adjustable desktop is designed to assist individuals to be more alert and productive as they work. Studies show that moving from a sitting to standing position and vice versa help the human body to be more awake and alert.

Additional advantages and elements provided by the height adjustable desktops disclosed herein may include straight vertical motion of the desktop platform where the work surface does not protrude out toward the operator when elevated, a motorized adjustable height mechanism or other motor assisted system that prevents back strain, a holding or locking mechanism that does not limit the work surface to only preset heights, a higher maximum adjustable height to satisfy taller users, a keyboard tray that can be moved horizontally and vertically, improved aesthetic design, increased load capacity, and a more compact design once in a lowered position.

Figure 2:
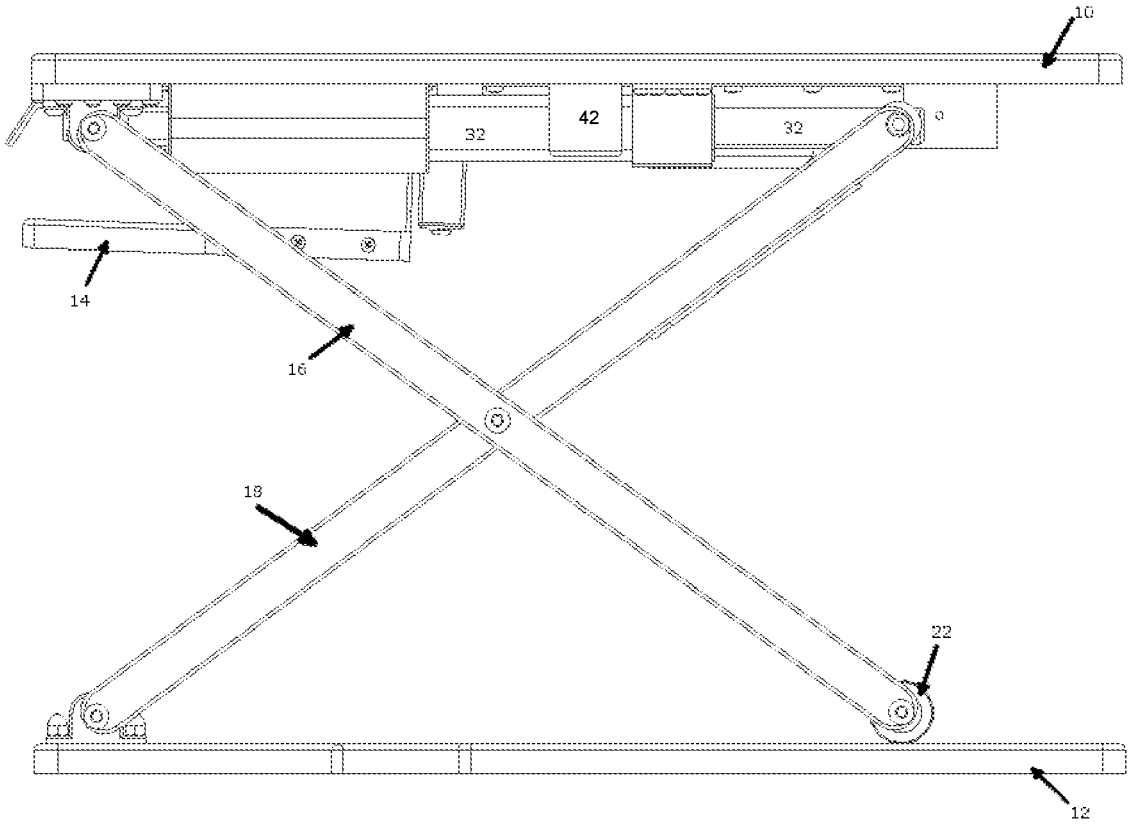
FIG. 2 is a side view of an example height adjustable desktop.

FIGS. 1A, 1B, 1C, 1D, and 1E show a perspective view of a height adjustable desktop in an assembled state. FIG. 2 shows a side view of height adjustable desktop in an assembled state. As shown, the height adjustable desktop can include an upper work surface platform 10, a base 12, and a height adjustment mechanism residing between the upper work surface platform 10 and base 12. Platform 10 is a work surface that can support desk items, for example, monitors, tablets, computers, notebooks, and other objects. In order to maximize the work surface, platform 10 is predominantly whole without a cut-out or drop down to make room for a keyboard tray or additional lower worksurface. Said another way, a perimeter of a major surface of the upper work surface platform provides a convex shape without such a cut-out. In this example, there is not a lowered. keyboard platform or other platform that is attached to the upper work surface platform that reduces the work surface of platform 10.

However, a configuration of the height adjustable desktop can exist where the upper work surface platform has a reduced surface area to make room for a lower keyboard platform or work surface. In this configuration, a perimeter of a major surface of the upper work surface platform provides has a concave profile as a result of a cut-out in the upper work surface platform to facilitate the addition of a lower worksurface or keyboard platform proximate the cut-out.

The height adjustment mechanism can include at least one set of two pivoting arms 16 and 18, such as two sets of pivoting arms 16 and 18. Pivoting arms 16 and 18 are connected at some point along their shafts at pivot point 20. These pivoting arms can connect at pivot points 24 and 26 on one end and can move horizontally along base 12 with sliding mechanisms, such as rolling wheels 22 at the other end. The arms pivot at 20, 24, and 26, and the arms slide or roll with element 22 and 28, creating a scissor motion to allow the upper work surface platform 10 to move up and down. The pivoting arms moving in the scissor motion is the basis of the height adjustment mechanism. Base 12 is the base that the height adjustment mechanism connects to in this example. Base 12 can include one piece of material or multiple pieces of material.

Pivot point 24 is the element that pivotably attaches the base 12 to arm 18. The height adjustable desktop in FIG. 1A-1E shows pivot 24 on the outer corner of base 12; pivot 24 could be located further in towards the center of base 12 and could be created as a stand-alone element such as a bracket or similar device. Pivot 24 is to be understood as a connection between base 12 and arm 18, and to be a pivot point that allows arm 18 to rotate as part of the scissor motion of height adjustment mechanism.

The height adjustable desktop could exclude base 12. In such a configuration, the height adjustment mechanism can connect directly to the desk or surface that the height adjustable desktop is sitting on. The lower portion of arm 18 and roller or slider 22 can connect or rest directly on the surface the height adjustable desktop is resting upon and slide or roll in a similar motion with an independent sliding mechanism such as, but not limited to a wheel, bearing, roller, track, or guide.

Figure 3A:
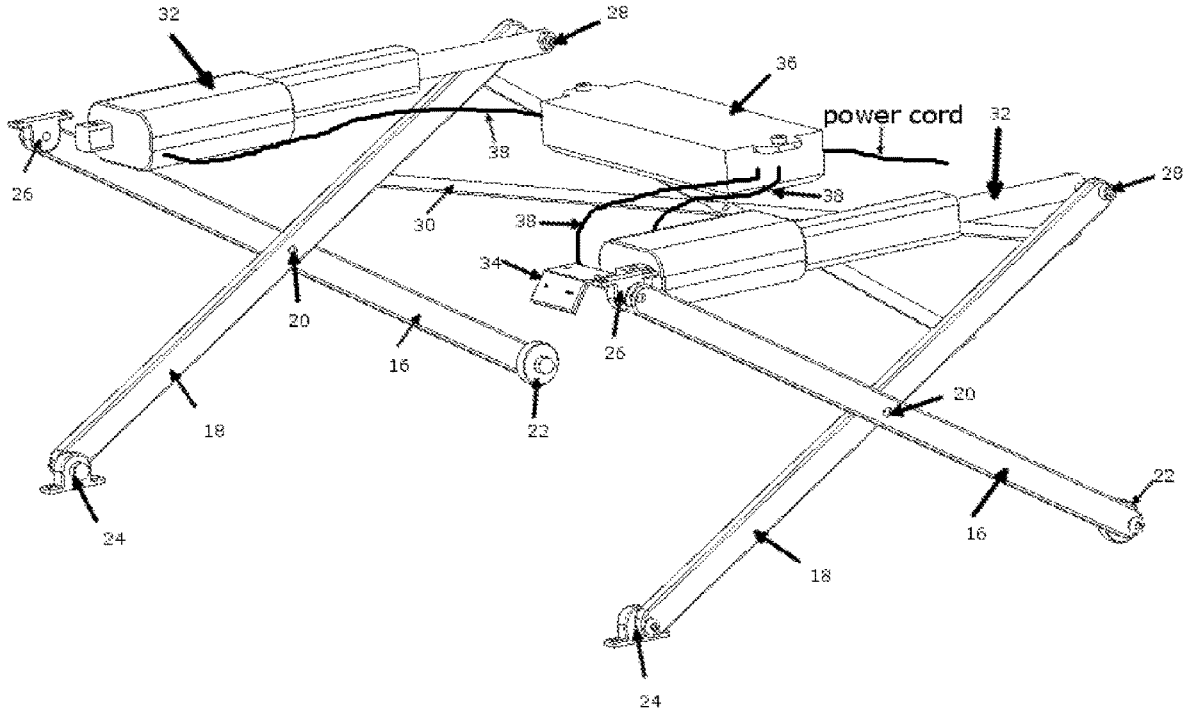
FIG. 3A is a perspective view of parts of an embodiment of a height adjustment mechanism of the height adjustable desktop from FIG. 1A-1E.

FIG. 3A shows the height adjustment mechanism, which assists in the vertical motion achieved to move the upper work surface platform 10 up and down in a smooth motion. The height adjustment mechanism can be designed so that it creates a vertical motion without any lateral or protruding motion side to side. Said another way, the scissor motion that height adjustment mechanism creates allows upper work surface platform 10 to stay in alignment with base 12 as it raises or lowers. This alignment is intended, but other uses could include a method that does not align element 10 and 12 as raised and lowered, but rather, purposely misaligns them.

The height adjustment mechanism can include of one or more pairs of pivot arms 16 and 18, which have a connection and pivoting point 20 at some point along their axis. Arm 16 connects at pivot element 26, pivot point 20, and at rolling or sliding element 22. Similarly, arm 18 can connect at pivot element 24, pivot point 20, and at pivot point 28. The height adjustment mechanism can also include components that make the height adjustable desktop more rigid, such as cross beam supports labeled as element 30 in FIG. 1A-1E. Element 30 or other structural elements could connect to the actuator(s) or other driving force element to stabilize or distribute the force applied to the arms. Pivot arms, pivot points, and sliding elements are designed to fit compactly together when the height adjustable desktop is in a lowered position, as can be seen in FIGS. 1E, 5B, 5C, and 6. The height adjustable desktop is not limited to specific elements or locations of elements to achieve the height adjustment motion.

As also shown in FIGS. 1A, 1B, 2, 5B, and 5C, the height adjustable desktop can include optional bumpers 42 secured to the bottom surface of upper work surface platform 10 proximate the pairs of pivot arms 16 and 18, such as proximate pivot point 20 when upper work surface platform 10 is in the fully lowered position. Bumpers 42 serve to provide a positive stop for the fully lowered position of upper work surface platform 10 by limiting further travel of pivot arms 16 and 18. Bumpers 42 may be formed from an elastomeric material, such as rubber, or a stiff material such as a metal or polymer.

FIG. 1A through FIG. 1E suggests that pivot points 24 and 26 are located near the front edge of the height adjustable desktop, and that sliding or rolling mechanisms 22 and pivot points 28 are located towards the back edge of the height adjustable desktop when in a lowered position. The configuration of the height adjustable desktop is possible where the locations of the pivot points and rolling mechanisms are at opposite sides, or some combination of both. The height adjustable desktop could also be configured where the scissoring arms are along the front and back edges of the top surface and the base, and where pivot points 24 and 26 would be on the left or right side and sliding or rolling mechanisms 22 would be towards the right or left sides opposed to the front or back of base 12. Said another way, when a user is standing in front of the height adjustable desktop, the user would see the scissoring arms directly in front of them and parallel to the front edge of the upper work surface platform 10, opposed to on the sides and perpendicular to the front edge of the upper work surface platform 10.

Figure 3B:
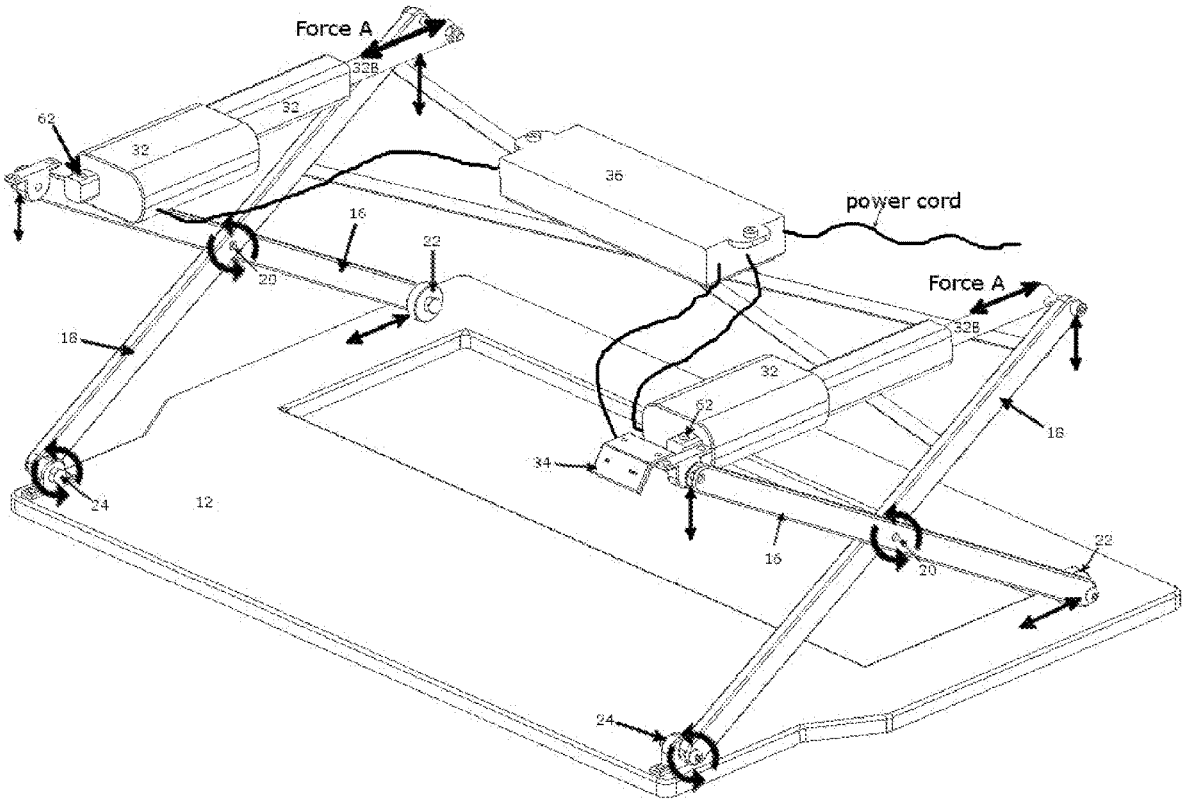
FIG. 3B is a perspective view of parts of an embodiment of a height adjustment mechanism attached to the base of the height adjustable desktop from FIG. 1A-1E.

As can be seen in FIGS. 3A and 3B, arms 18 can attach to a force providing element, actuator 32, at connection point 28. The force providing element(s) could also attach directly to cross support element 30 or similar. The force providing device can be a linear actuator or other motorized component. A linear actuator creates motion in a straight line, in contrast to the circular motion of a conventional electric motor. A linear actuator can be configured in different fashions, for example, a linear actuator can contain a rod that extends and retracts from its housing to generate the straight line of motion, or a component can move in a straight line along a fixed shaft, this is often referred to as a track actuator. In the same or different examples, actuator 32 can include a worm gear or rack and pinion to convert rotary motion to a non-rotary motion in order to raise and lower upper work surface platform 10. Actuator 32 includes a rod or moving platform, labeled as 32B that is to be considered part of actuator 32, that extends and retracts from the main body of linear actuator 32 or moves along the body of actuator 32 as in a track actuator. Actuator 32 can be connected to control box 36 via a cable or wireless connection, such as wires 38, and control switch 34 can be connected to control box 36 via a cable or wireless connection, and control box 36 can contain a power cord that plugs into a power source or receives power by other means. Control switch 34 could be a mobile or other wireless device that sends commands to the control box 36.

Control switch 34, control box 36, and actuators 32 work together to ensure that both actuators' rods or moving platform, 32B, move the same distance to ensure the upper work surface platform 10 stays parallel to the surface the height adjustable desktop sits on as it raises and lowers. Actuators 32 have a means to detect how much they have moved, retracted or extended by means of a feedback sensor such as hall sensor, potentiometer, encoder or other sensor. The control box 36 utilizes the data provided by the feedback sensor to control how much each actuator moves, extends or retracts to ensure that they both move the same amount regardless of the load they are carrying, to ensure that the top surface 10 stays primarily parallel to the surface the height adjustable desktop rests upon. A configuration of the height adjustable desktop could also include one that utilizes sensors and a control box to purposely move each actuator a different distance, where the desired positions of top surface 10 was not one that was parallel. Such a configuration could be utilized for an angled drafting table or other application where a non-flat surface is desired. The control box 36 may comprise a processor and a non-transitory computer readable medium comprising computer readable instructions for causing the processor to perform the control techniques described herein.

Force providing actuator 32 also acts as the locking device to hold the height of the upper work surface platform 10. This allows the operator to stop the top surface 10 at any height. Said another way, there are no pre-set locking points or heights. The operator will use the controls on control switch 34 to move surface 10 to their desired height and then component 32 will hold that vertical position until the operator changes the height with switch 34. The height adjustable desktop has an infinite number of stopping points since there are no pre-set locking points required with the actuators.

The height adjustable desktop can move vertically and be held or locked into position at various heights. The height adjustment mechanism utilizes actuator actuator 32 or similar, to lock or hold desktop surface 10 in the desired vertical position. Utilizing the actuator or similar force driving mechanism, can allow the operator to adjust the height without the limitations of preset heights that some other locking mechanisms only provide. Instead of preset heights created by an element with features such as preset holes or teeth, the actuator or something similar would allow the operator to set the height limit by stopping the actuator or similar at any point the operator chooses. The internal mechanisms of the actuators 32, or similar elements, would hold the vertical position of surface 10 when switch 34 is not being utilized to send commands to raise or lower surface 10.

FIG. 3B shows the height adjustment mechanism with forces applied by actuators 32 to arms 18. FIG. 3B also shows many of the possible linear and rotational motions of the components of the height adjustment mechanism that allow for the vertical motion of the height adjustable desktop's upper work surface platform 10. Elements 32 can apply a pushing and pulling force to arms 18, which causes arms 16 and 18 to move in a scissor motion. Element 32, which applies force to height adjustment mechanism, is a linear actuator or track actuator or can be a variety of different mechanisms applying the force.

FIG. 3B include arrows that show some of the possible motions of the height adjustment mechanism. Pivot arms 16 and 18 are connected to one another at pivot point 20. One end of arms 18 attach to pivot points 24, and pivot points 24 attach to base 12. The other end of arms 18 attach to force applying actuator 32 at pivot connection point 28. Arms 16 attach to pivot points 26, and pivot points 26 attach to upper work surface platform 10 as seen in FIG. 1A. The other end of arms 16 attach to rolling or sliding element 22, which rests upon or is attached to base 12.

As seen in FIG. 3B, when the operator uses the up and down controls on switch 34, actuators 32 apply a pushing or pulling force by moving, extending or retracting actuators 32B, labeled as Force A. When Force A is pulling, where actuators 32B are moving towards the front of the base, it pulls on arm 18 at pivot point 28. When the pulling force is applied, pivot points 24 rotate; pivot points 26 rotate and move vertically in an upward motion; points 20 and 28 rotate and move both horizontally towards pivot points 24 as well as vertically in an upward motion away from base 12; and element 22 rotates or slides on base 12 in a horizontal motion towards pivot points 24. Since pivot points 26 are connected to upper work surface platform 10, and actuators 32 are attached to upper work surface platform 10, via connection points 62 (seen on FIG. 3B) and via bracket 64 (seen on FIG. 1B), when the described upward motion of the height adjustment mechanism occurs, upper work surface platform 10 raises. This described motion is the basis for how surface 10 moves in an upward direction.

Inversely, when actuators 32 apply a pushing or extending force away from the front edge, a lowering motion of surface 10 is created. All pivot points rotate in the opposite direction as described above; pivot points 26 move vertically in a downward motion, points 20 and 28 move horizontally away from pivot points 24 as well as in a downward motion towards base 12, and element 22 rolls or slides in the opposite direction on base 12 in a horizontal motion away from pivot points 24. The mechanics described above are the basis of how the height adjustable desktop raises and lowers the desk surface 10; it is not intended to limit the scope of the present design; the height adjustment mechanism may include deviations and modifications that one skilled in the art would find apparent.

Switch 34 can include up and down controls, memory preset controls, or other controls to allow the operator to control actuators 32 to move the upper desk surface 10 to its desired height. Switch 34 could be part of an external device such as a mobile phone application or smart watch to send commands to the height adjustable desktop.

Connection points 28 includes a pin, bolt or other element that attach actuator 32 to arm 18 and allows for rotational motion, basically creating a direct connection from actuator actuators 32 to arms 18. Element 32 could connect to element 30, in which case, connection points 28 would connect to element 30. Connection points 28 could include rolling or sliding elements similar to element 22 that could roll or slide along top surface 10 and provide additional support to surface 10.

The height adjustable desktop can utilize actuator 32 or similar element in a different location; for example, the element could attach directly to arms 16 or 18, or to one of the pivot points, or to another element such as a crossbeam that connects to the arms.

As seen in FIG. 1A-1E, embodiments can include a keyboard platform 14, that attaches to upper work surface platform 10. Platform 14 can be independently adjusted both horizontally and vertically. An exemplary use of platform 14, is to support items such as a keyboard tray, mouse, mouse pad, or other items, and where platform 14 can be moved to a desired vertical position and a desired outward or inward position by the operator. Neither the horizontal nor the vertical positions are limited by pre-set locking points. Said another way, there is an unlimited number of vertical and horizontal positions the operator could locate the platform 14. The height adjustable desktop could include a design where there is an element to lock the horizontal or vertical position of platform 14. The description suggests the device is used for supporting typical keyboard tray objects, but the scope of the disclosure is intended to support other objects and could be used in other applications.

Figure 4A:
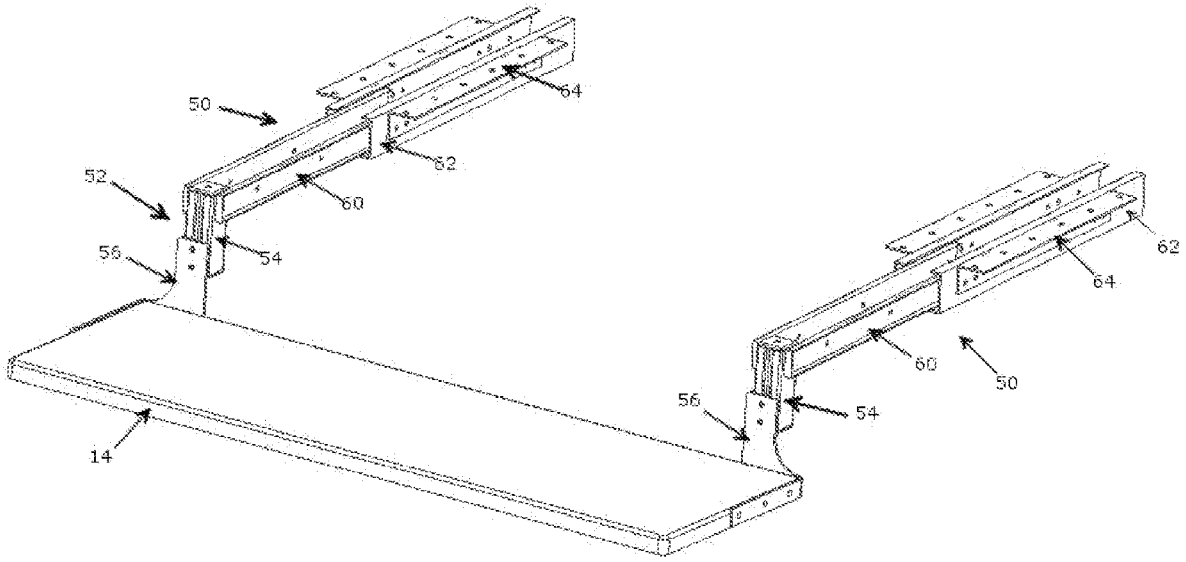
FIG. 4A is a perspective view of an optional keyboard tray that could be part of height adjustable desktop from FIG. 1A-1E.
Figure 4B:
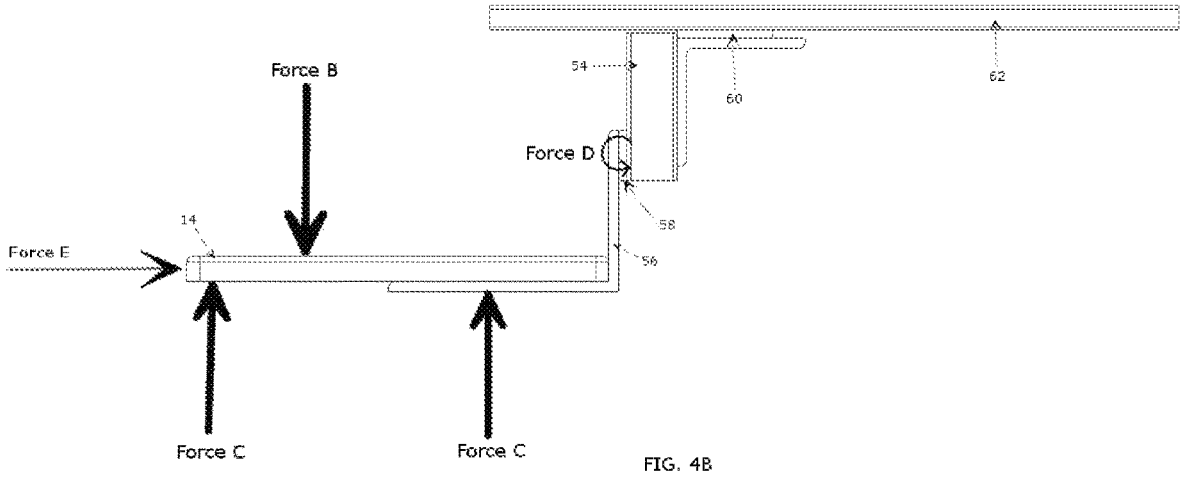
FIG. 4B is a side view of an optional keyboard tray that could be part of height adjustable desktop from FIG. 1A-1E, showing forces applied to the keyboard tray that keep it in place and allow it to move horizontally and vertically.
Figure 4C:
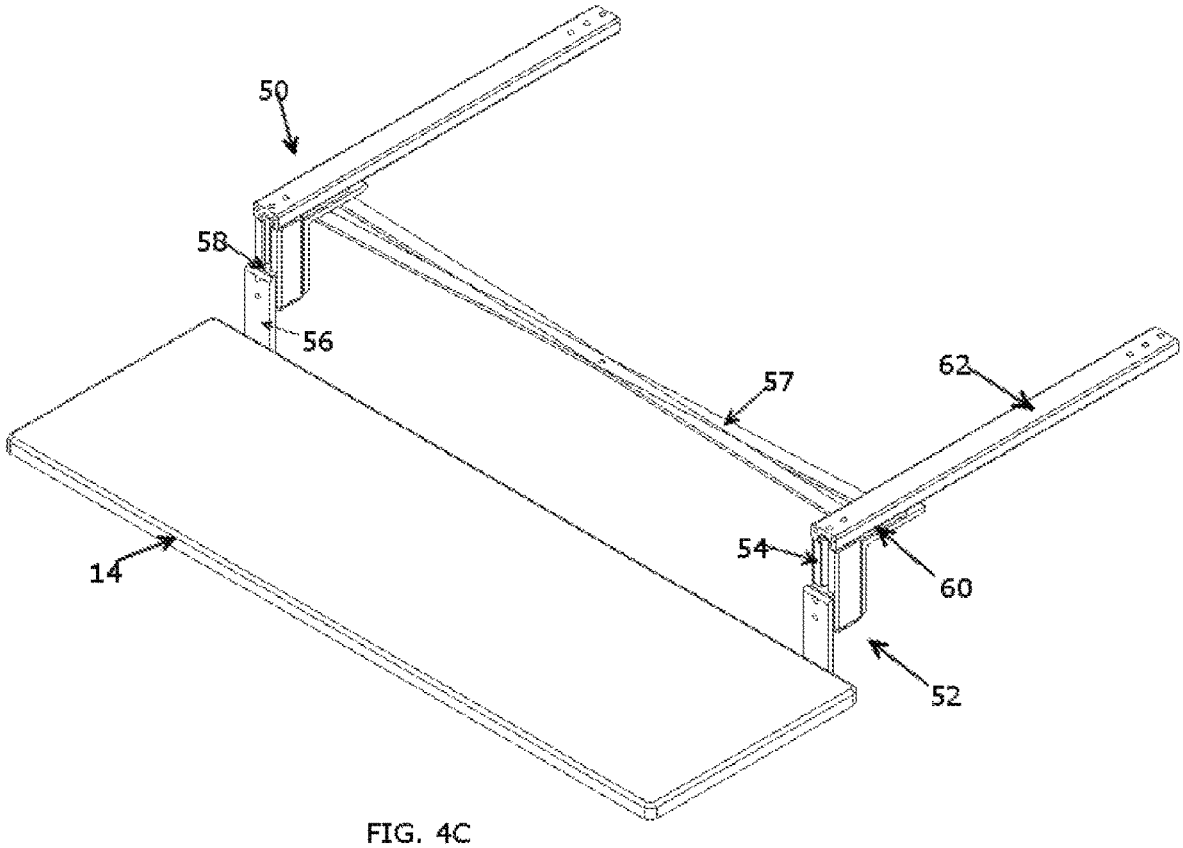
FIG. 4C is a perspective view of an optional keyboard tray with a cross support element, that could be part of height adjustable desktop from FIG. 1A-1E
Figure 5A:
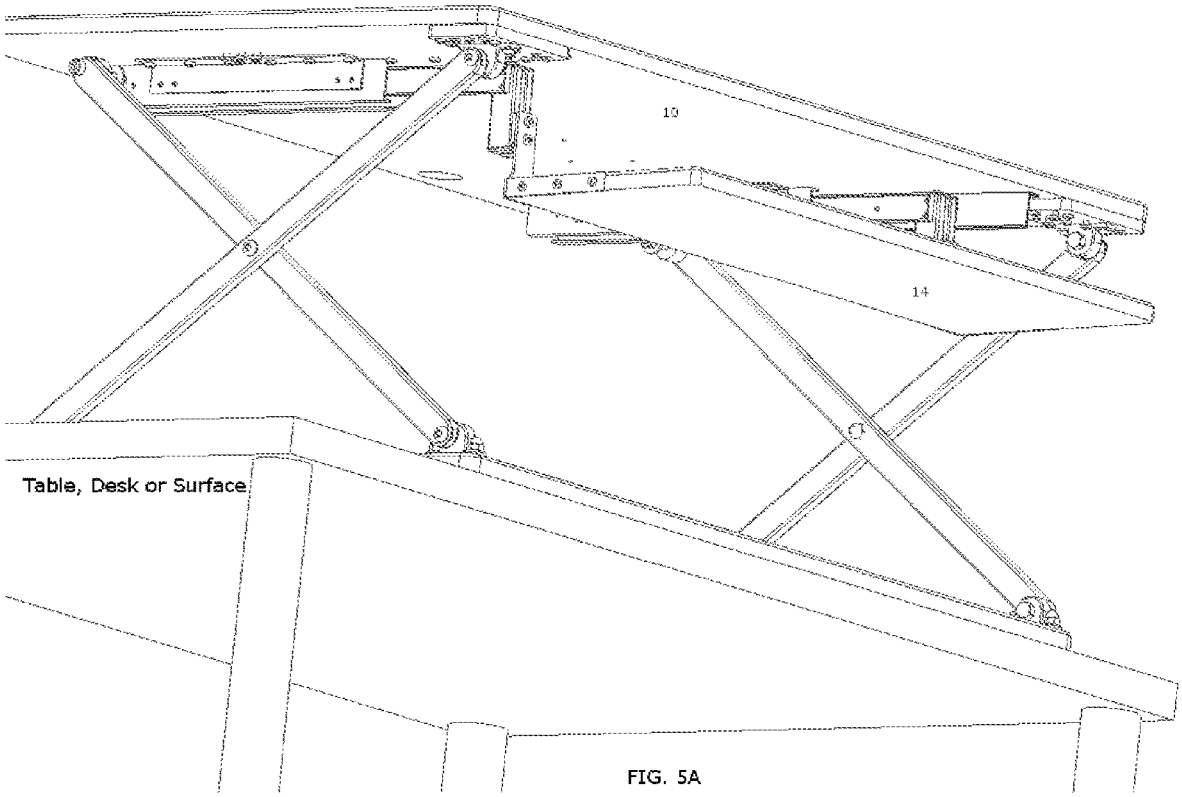
FIG. 5A is a perspective view of an example height adjustable desktop in a partially raised state sitting on a table or desk.
Figure 5B:
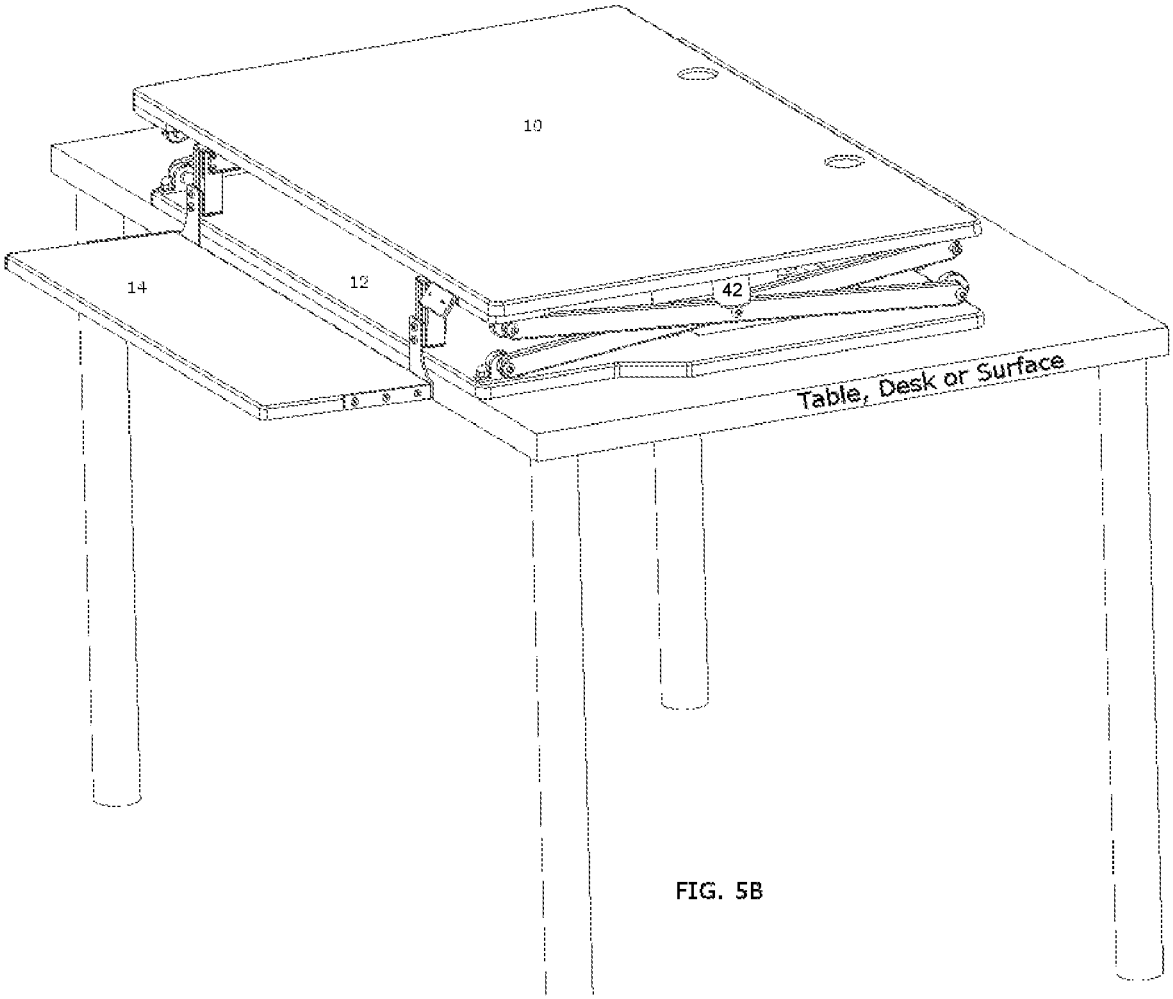
Figure 5C:
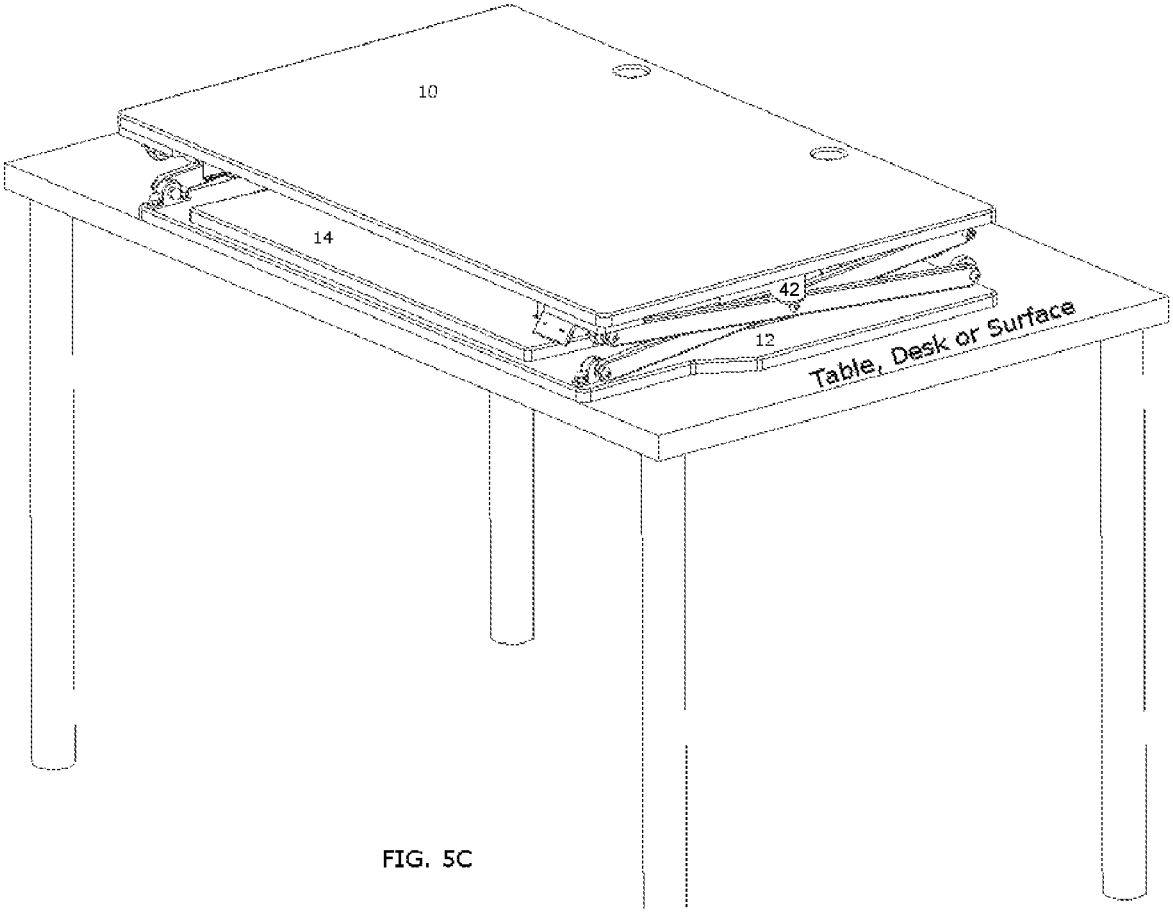
FIG. 5C is a perspective view of an example height adjustable desktop in a lowered state sitting on a table or desk, where the optional keyboard tray is in a closed and raised position, so that the keyboard tray is tucked away inside the height adjustable desktop.
Figure 6:
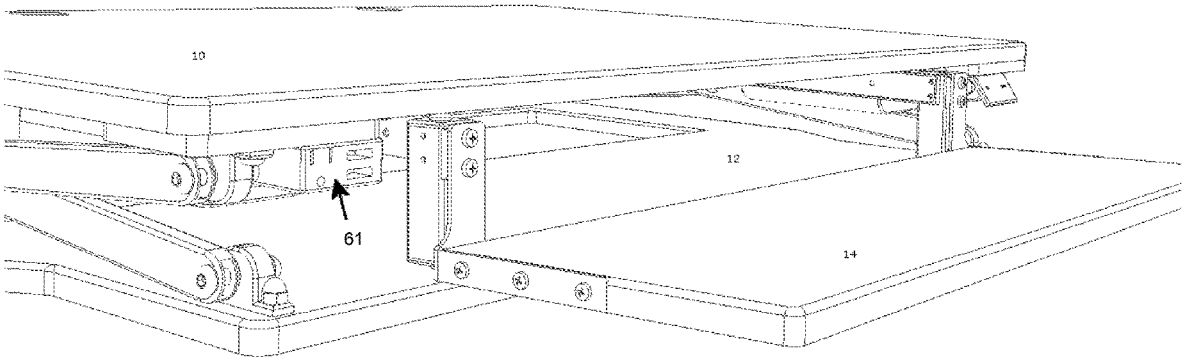
FIG. 6 is a perspective view, showing an example height adjustable desktop with power and data ports.
Figure 7:
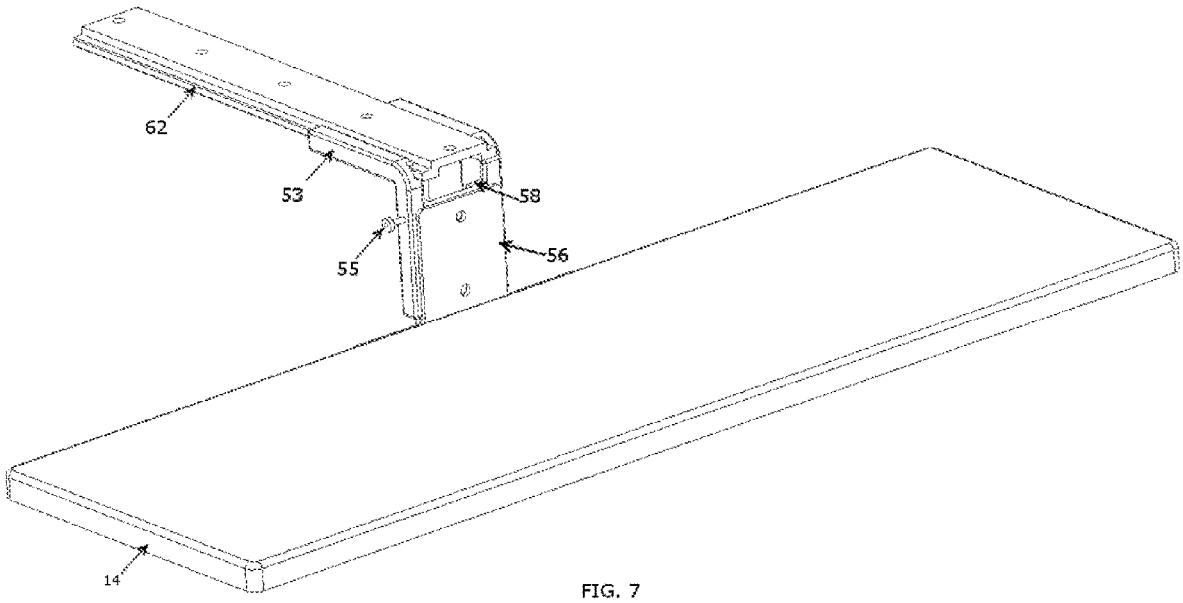
FIG. 7 is a perspective view of an optional keyboard tray with a single vertical and horizontal slider that could be part of the height adjustable desktop from FIG. 1A-1E

FIGS. 4A and 4C show a perspective view of the keyboard platform assembly separated from upper work surface platform 10. The view shows two vertical position adjustment mechanisms 52 and two horizontal adjustment mechanisms 50. FIG. 4B shows a side view of the keyboard platform assembly separated from upper work surface platform 10. As shown, the keyboard platform assembly can include a platform 14, vertical position adjustment mechanisms 52 and horizontal position adjustment mechanisms 50. FIG. 6 is a perspective view, showing an example height adjustable desktop with power and data ports 61. FIG. 7 shows a perspective view of the keyboard platform assembly with only one vertical position adjustment mechanism 52 and only one horizontal adjustment mechanism 50.

Horizontal adjustment mechanism 50 allows platform 14 to be positioned in various horizontal locations. Mechanism 50 can include of one or more horizontal tracks or guides 62, and a sliding or rolling component 60 that moves along element 62. Mechanism 50 can be affixed to upper work surface platform 10, as seen in FIG. 1A. Elements for mechanism 50 are suggested, however, the design is not limited to specific elements to achieve the horizontal motion of the keyboard platform.

Vertical adjustment mechanism 52 allows platform 14 to be positioned in various vertical locations. Mechanism 52 can include of one or more vertical tracks or guides 54, and sliding or rolling component 58. Vertical mechanism 52 can attach directly to platform 14 or by another element such as bracket 56. Elements for mechanism 52 are suggested, however, the design is not limited to specific elements to achieve the vertical motion of the mechanism.

Horizontal and vertical adjustment mechanisms 50 and 52 can be connected by additional components or brackets or directly connected to one another. Horizontal adjustment mechanism 50 and vertical adjustment mechanism 52 can be connected by element 53, as seen in FIG. 7. In this configuration, elements 54 and 60 are combined into single element 53.

In the case where the height adjustable desktop includes two or more sets of vertical and horizontal mechanisms 50 and 52, as seen in FIG. 4C, element 57 can be utilized to connect the mechanisms to one another to add stability and to make the height adjustable desktop more rigid.

Horizontal mechanism 50 can be affixed to upper work surface platform 10 or another surface as seen in FIG. 1A-1E, FIG. 8, and FIG. 9. FIG. 4B shows how forces applied to the keyboard platform assembly can affect the location of platform 14. When a horizontal Force E is applied by the user, or by another component such as a spring, motor, or other, horizontal mechanism 50 allows platform 14 to move to a new position either closer to or further away from the user on the horizontal plane. When Force E is applied, Platform 14 will be positioned further from the user; inversely, when a force is applied in the opposite direction of Force E, platform 14 will be located closer to the user. Platform 14 can be moved to a position underneath the upper work surface platform 10, or platform 14 can protrude partially or completely out away from the front edge of upper work surface platform 10.

Vertical mechanism 52 can be affixed to a keyboard tray or other platform 14. Vertical mechanism 52 allows the user to apply a vertical force to the mechanism or platform 14 that will relocate the vertical position of platform 14. The vertical position of platform 14 will be held by the friction and angular forces created by gravity between elements 54 and 58. As seen in FIG. 4B, Force B represents the force of gravity, which leads to rotation Force D. The rotational Force D creates friction between elements 54 and 58 or similar, which allows the height of platform 14 to be maintained. To increase such friction, vertical element 54 may be attached so that it is at an angle different than 90 degrees with respect to upper work surface platform 10 or the horizontal plane. In addition, such a friction may be varied by utilizing different materials for elements 53, 54, 58, and 56. If a user pushes down on the outer edge of platform 14 it will increase the friction and platform 14 will maintain its vertical position. If a rotational force is applied in the opposite direction of Force D, then the force between elements 54 and 58 will be reduced, allowing platform 14 to have the ability to be moved up or down. An upward force such as Force C in FIG. 4B, would result in the described rotational force opposite to Force D. Consequently, if an upward force is applied by a user or by upper work surface platform 10 being lowered into base 12 or other force that is applied in such a way that reduces the angular force holding platform 14 in its current position, then platform 14's vertical position will move upward. Said another way, the weight of platform 14 will hold platform 14 in place, but if a user applies a force such that the angle between elements 54 and 58 are moved so that they line up and friction is reduced, then platform 14 will be free to move up and down. If the upward Force C or downward Force B is greater than the opposing forces that frictional Force D creates, then platform 14 will be able to move in the vertical direction. To ensure that Platform 14 does not move vertically, an additional locking mechanism, element 55, may be added. Element 55 can be a screw or spring loaded pin or similar element that applies a force to element 58 to hold the vertical position of platform 14. For example, in FIG. 7, element 55 is threaded and can be screwed into element 53 so that it applies a force to element 58, where the force does not allow vertical motion of element 58. Elements 53, 54, or 58 could include teeth or cut-out elements to hold the vertical position of platform 14. One reason for such a design is so that the user can adjust the height of platform 14 to a more ergonomic position. Another reason for such a design is so that when keyboard platform 14 is located under upper work surface platform 10, and when upper work surface platform 10 is lowered, platform 14 will move up vertical when it makes contact with base 12, so that it doesn't become a point of impact that could damage the height adjustable desktop.

The height adjustable desktop can include a configuration where horizontal motion is not permitted and only vertical motion is permitted. In such configurations, horizontal adjustment mechanism 50 would not be included, and element 54 or 55 would attach to the table or upper work surface platform. Such a configuration could exist in an application where horizontal motion of platform 14 is not desired.

The height adjustable desktop can include a configuration where vertical motion is not permitted and only horizontal motion is permitted. In such configurations, vertical adjustment mechanism 52 would not be included. Such a configuration could exist in an application where vertical motion of platform 14 is not desired.

Figure 8:
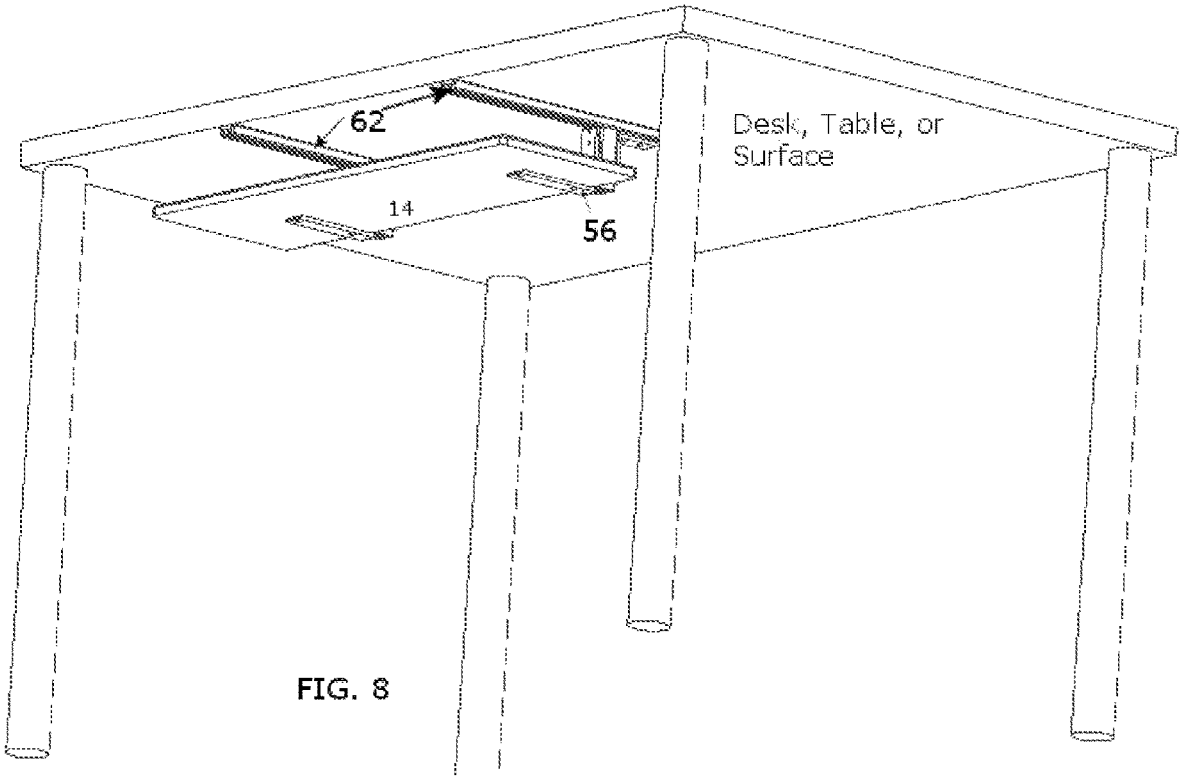
FIG. 8 is a perspective view of an optional keyboard tray mechanism that could be attached directly to a desk, table or surface
Figure 9:
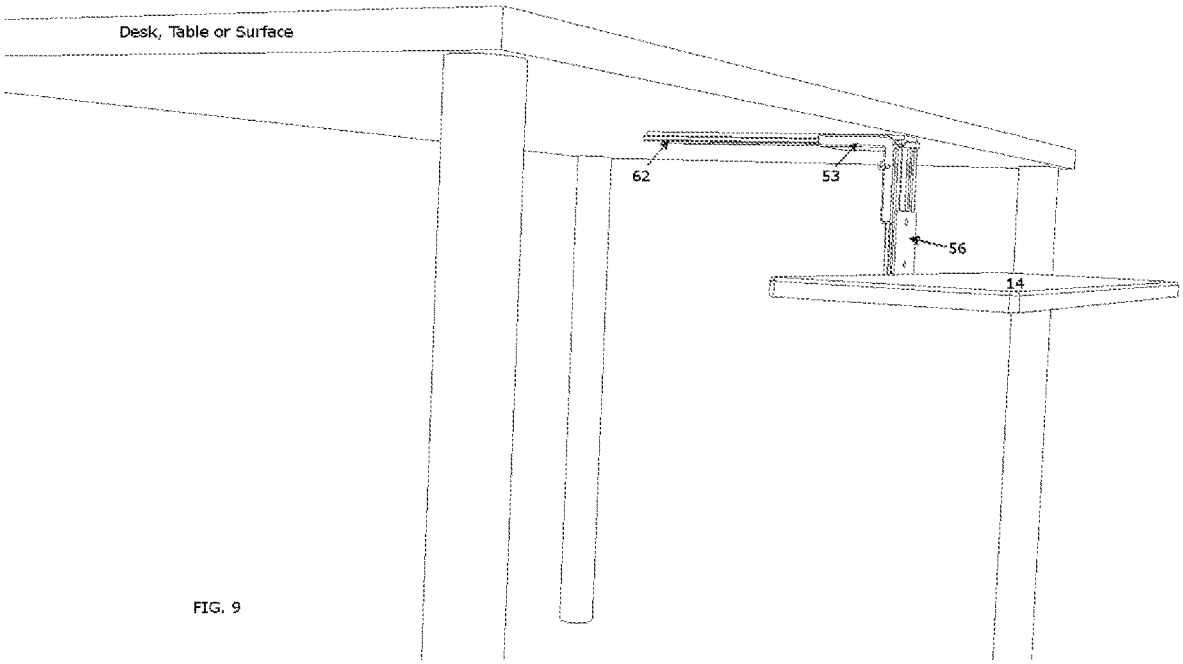
FIG. 9 is a perspective view of an optional keyboard tray mechanism with a single horizontal slider that could be attached directly to a separate desk, table or surface

The height adjustable desktop can include a configuration where the keyboard tray is used independently and attached directly to a table, desk or surface as in FIG. 8 and FIG. 9.

Elements for keyboard platform assembly are suggested, however, the height adjustable desktop is not limited to specific elements to achieve the function of the keyboard tray mechanism.

Various examples of this disclosure have been described. These and other examples are within the scope of the following examples and claims.

Example 1: A keyboard platform that adjusts horizontally and vertically, comprising:

a platform;

a horizontal adjustment mechanism that in part includes at least one set of tracks, guides, rollers, or other that allows for a horizontal motion of the said platform;

a vertical adjustment mechanism that in part includes at least one set of tracks, guides, rollers, or other that allows for a vertical motion of the said platform; and brackets and elements that connect the platform, horizontal adjustment mechanism, vertical adjustment mechanism, and an external surface to one another.

Example 2: A keyboard platform that adjusts horizontally and vertically recited in example 1, that includes components that allow said platform to move in a manner that positions the platform in a direction that protrudes out and down from a work surface platform it is attached to, and allows the platform to be positioned so that it is compactly located underneath the work surface.

Example 3: A keyboard platform that adjusts horizontally and vertically recited in example 1, that includes components that allow said platform to protrude out beyond the surface it is attached to; and if attached to a height adjustable desk that converts and existing desk into a height adjustable desk or similar, the keyboard platform can be located below the surface the height adjustable desk rests on when the height adjustable desk is in a lowered position.

Example 4: A keyboard platform that adjusts horizontally and vertically recited in example 1, comprising at least one stabilizing arm to make the invention more rigid.

Example 5: A keyboard platform that adjusts horizontally and vertically recited in example 1, where the horizontal adjustment mechanism attaches to an existing surface such as a desk, table, or height adjustable desk.

Example 6: A keyboard platform that adjusts horizontally and vertically recited in example 1, where the vertical adjustment mechanism attaches to an existing surface such as a desk, table, or height adjustable desk.

Example 7: A keyboard platform that adjusts horizontally and vertically recited in example 1, where the horizontal adjustment mechanism allows the operator to apply a force to move the keyboard platform in a horizontal motion to locate the platform closer to or further away from the operator.

Example 8: A keyboard platform that adjusts horizontally and vertically recited in example 1, where the vertical adjustment mechanism allows a vertical force to be applied that will move the keyboard platform to a new vertical position.

Example 9: A keyboard platform that adjusts horizontally and vertically recited in example 1, where the force applied in example 8 can be manually applied by the operator, or applied by a force that is a result of a height adjustable desk lowering, where the lowering surface causes the keyboard platform to make contact with another surface that the height adjustable desk rests on or is a part of, or with assistance from a spring, motor or other external force.

Example 10: A keyboard platform that adjusts horizontally and vertically recited in example 1, where the vertical adjustment mechanism can hold the keyboard platform's vertical position at an unlimited number of heights where there are no preset locking heights.

Example 11: A keyboard platform that adjusts horizontally and vertically recited in example 1, where the vertical adjustment mechanism in example 10 holds the keyboard platform's position by means of a downward force, and the angular force and friction created between elements of the vertical adjustment mechanism.

Example 12: A keyboard platform that adjusts horizontally and vertically recited in example 1, where the force applied in example 11 can be the force of gravity as a result of the weight of the keyboard tray and items resting on the keyboard tray, or force applied by the operator or other means such as a spring or other element.

Example 13: A keyboard platform that adjusts horizontally and vertically recited in example 1, where the angular force and friction holding the vertical position of the keyboard platform is a result of gravity and the connection of elements that comprise the vertical adjustment mechanism, where the connections cause a rotational force where elements are pushed together creating friction to hold the keyboard platform in place.

Example 14: A keyboard platform that adjusts horizontally and vertically recited in example 1, where the vertical adjustment mechanism holds the keyboard platform by means of a locking mechanism.

Example 15: A keyboard platform that adjusts horizontally and vertically recited in example 1, where the vertical adjustment mechanism makes contact with a rigid element that is part of or separate from the vertical adjustment mechanism, that prevents further downward motion, holding the keyboard platform in a vertical position.

Example 16: A keyboard platform that adjusts horizontally and vertically recited in example 1, where an upward force can be applied to reduce the angular force and friction of example 13, to allow the keyboard platform to not be held in its current position and thus moved up or down.

Example 17: A keyboard platform that adjusts horizontally and vertically recited in example 1, where it does not include a platform.

Example 18: A keyboard platform that adjusts horizontally and vertically recited in example 1, where it does not include a horizontal adjustment mechanism.

Example 19: A height adjustable desktop, comprising:

an upper work surface platform;

a base platform, which can rest on an existing desk, platform, surface, or table;

a height adjustment mechanism that in part includes two sets of two arms that connect at a pivot point along their lengths so that the arms can move in a scissoring motion as part of the method to raise and lower the said upper work surface; and mechanisms applying a force to the said arms that are two linear actuators that contain feedback sensors that provide data regarding the current position and distance each of their extending rods have extended or retracted.

Example 20: A height adjustable desktop recited in example 19, wherein one end of one of the arms in each arm set is attached to the upper work surface at a pivoting point, and the other end is attached to a wheel, bearing or other rolling mechanism that allows a rolling motion along said base surface; and wherein one end of the other arm of the arm set is attached to the base at a pivoting point, and the other end is attached to the force applying mechanism cited in example 1.

Example 21: A height adjustable desktop recited in example 19, wherein a keyboard platform mechanism can be included as part of the design, that in part includes a keyboard platform and components that allow the keyboard platform to be located at various heights and horizontal positions with respect to the upper work surface that it is attached to.

Example 22: A height adjustable desktop recited in example 19, wherein the linear actuators connect to the arms with a pin, screw, or other component that allows a force to be applied to the arms.

Example 23: A height adjustable desktop recited in example 19, wherein each actuator is attached to the upper work surface, and the actuating rod is directly attached with a pin, screw, or other component to the said arms allowing the actuators to apply a force to the arms.

Example 24: A height adjustable desktop recited in example 19, wherein the distance the actuators extend or contract is controlled by the input the operator inputs into a control switch, which transfers the desired motion data to a control box, the control box then uses the data provided by the control switch in combination with the output data provided by the feedback sensors in the actuators, to ultimately command the actuators to independently extend or contract the correct distance to keep them in unison and ensure the upper surface stays predominantly level or parallel to the base surface as it raises, lowers, or is at rest.

Example 25: The control switch recited in example 24, could include up and down buttons, preset buttons or other controls that an operator could utilize to provide an input to the control box and actuators.

Example 26: The control box recited in example 24, wherein the control box could include technology that allows it to accept actuator or other motor feedback sensor data that it could then use to provide the correct amount of energy and the correct phase of energy to the actuators or motor(s), to ensure the actuators or other motors move the arms the correct distance to raise and lower the upper work surface, and at the same time keep the upper surface predominantly level.

Example 27: The control box recited in example 24, wherein the control box could include technology that allows it to accept actuator or other motor feedback sensor data that it could use to then provide the correct amount of energy and the correct phase of energy to the actuators or motor(s), to ensure the actuators or other motors move the arms the correct distance and direction to locate the upper work surface in a position that is at a desired angle that may not be predominantly parallel to the base surface.

Example 28: A height adjustable desktop recited in example 19, wherein the mechanisms applying the force are not two linear actuators, but another type of motor or mechanism actually applies the force, and wherein the force applying mechanisms are not limited to two mechanisms, but could be one or any number of force applying mechanisms.

Example 29: A height adjustable desktop recited in example 19, wherein the height adjustment mechanism includes a control switch, control box, and electric actuators with feedback sensors that connect to the sets of arms; wherein this configuration allows the distance the actuator moves the arms to be controlled in an intelligent manner that allows the configuration to be setup to have the upper work surface move to a desired vertical height and maintain a desired angular position, whether that angular position is parallel with the base surface or at an angle that is not parallel to the base surface.

Example 30: A height adjustable desktop recited in example 19, wherein the linear actuator(s) act as the locking mechanism to maintain the upper work surface's vertical position, while also allowing for an unlimited number of stopping positions, allowing the operator to locate the upper worksurface at an unlimited number of vertical positions.

Example 31: A height adjustable desktop recited in example 19, further comprising at least one stabilizing crossbeam.

Example 32: A height adjustable desktop recited in example 19, wherein there is not a base platform, but instead, the surface the height adjustable desktop sits on acts as the base platform.

Example 33: The keyboard platform mechanism recited in example 21, wherein the keyboard platform mechanism allows the operator to move the keyboard platform in and out along the horizontal plane, as well as up and down along the vertical plane, where there are no horizontal or no vertical pre-set locking points, allowing for an unlimited number of horizontal and vertical positions the keyboard platform could be located.

Example 34: The keyboard platform mechanism recited in example 33, wherein the vertical location of the keyboard tray is maintained due to the forces of gravity and friction between the components that make up the keyboard platform mechanism.

Example 35: The keyboard platform mechanism recited in example 33, where an upward force can be applied to reduce the angular force and friction of example 16, to allow the keyboard platform to not be held in its current position and thus moved up or down.

Example 36: The keyboard platform mechanism recited in example 33, where the keyboard platform can be positioned so that it extends out beyond the base and can be located below the base when the height adjustable desktop is in a lowered position.

Example 37: A height adjustable desktop recited in example 19, further comprising an outlet with power and data ports.

What is claimed is:

1. A method comprising:

receiving an input signal to raise or lower an upper work surface platform of a height adjustable desktop, wherein the height adjustable desktop includes:

the upper work surface platform, a first actuator including a first feedback sensor that provides a first data regarding a current position of the first actuator, a second actuator with a second feedback sensor that provides a second data regarding a current position of the second actuator;

receiving the first data regarding the current position of the first actuator;

receiving the second data regarding the current position of the second actuator; and sending control signals to the first and second actuators corresponding to the input signal to raise or lower the upper work surface platform, the control signals accounting for the first and second data regarding the current positions of the first and second actuators such that the first and second actuators extend or contract in unison regardless of loads carried by the first and second actuators.

2. The method of claim 1, wherein the input signal is from a control switch operable to output control data in response a user input.

3. The method of claim 2, wherein the control switch includes one or more:

up and down buttons for an operator to provide the user input; and preset buttons for the operator to provide the user input.

4. The method of claim 1, wherein the input signal is a wireless input signal.

5. The method of claim 4, wherein the input signal in from a wireless external device such as a mobile device or smart watch.

6. The method of claim 1, further comprising stopping the first and second actuators to maintain a vertical position of the upper work surface platform.

7. The method of claim 1, further comprising:

applying, with the first actuator in response to the control signals, a first force on a first side of the upper work surface platform; and simultaneously applying, with the second actuator in response to the control signals, a second force on a second side of the upper work surface platform such that the first and second actuators extend or contract in unison.

8. The method of claim 1, wherein the height adjustable desktop further includes a height adjustment mechanism that includes two sets of two arms that connect at pivot points along their lengths so that the arms are configured to move in a scissoring motion to raise and lower the upper work surface platform.

9. The method of claim 8, wherein one end of one of the arms in each set of two arms is pivotably attached to the upper work surface platform, and the other end is attached to a sliding mechanism that allows a motion along a surface of a base, and wherein one end of the other arm of the set of two arms is pivotably attached to the base, and the other end is attached to one of the actuators.

10. A non-transitory computer readable medium comprising computer readable instructions for causing a processor to:

receive an input signal to raise or lower an upper work surface platform of a height adjustable desktop, wherein the height adjustable desktop includes:

the upper work surface platform, a first actuator including a first feedback sensor that provides a first data regarding a current position of the first actuator, a second actuator with a second feedback sensor that provides a second data regarding a current position of the second actuator;

receive the first data regarding the current position of the first actuator;

receive the second data regarding the current position of the second actuator; and send control signals to the first and second actuators corresponding to the input signal to raise or lower the upper work surface platform, the control signals accounting for the first and second data regarding the current positions of the first and second actuators such that the first and second actuators extend or contract in unison regardless of loads carried by the first and second actuators.

11. The non-transitory computer readable medium of claim 10, wherein the input signal is from a control switch operable to output control data in response a user input.

12. The non-transitory computer readable medium of claim 10, comprising further computer readable instructions for causing the processor to, with the control signals, stop the first and second actuators to maintain a vertical position of the upper work surface platform.

13. The non-transitory computer readable medium of claim 11, wherein the control switch includes one or more:

up and down buttons for an operator to provide the user input; and preset buttons for the operator to provide the user input.

14. The non-transitory computer readable medium of claim 10, wherein the input signal is a wireless input signal.

15. The non-transitory computer readable medium of claim 14, wherein the input signal in from a wireless external device such as a mobile device or smart watch.

16. The non-transitory computer readable medium of claim 10, wherein, in response to the control signals, the first actuator applies a first force on a first side of the upper work surface platform, and wherein, in response to the control signals, the second actuator simultaneously applies a second force on a second side of the upper work surface platform such that the first and second actuators extend or contract in unison.

17. The non-transitory computer readable medium of claim 10, wherein the height adjustable desktop further includes a height adjustment mechanism that includes two sets of two arms that connect at pivot points along their lengths so that the arms are configured to move in a scissoring motion to raise and lower the upper work surface platform.

18. The non-transitory computer readable medium of claim 17, wherein one end of one of the arms in each set of two arms is pivotably attached to the upper work surface platform, and the other end is attached to a sliding mechanism that allows a motion along a surface of a base, and wherein one end of the other arm of the set of two arms is pivotably attached to the base, and the other end is attached to one of the actuators.

19. The non-transitory computer readable medium of claim 10, wherein the control signals account for the first and second data regarding the current positions of the first and second actuators such that the first and second actuators extend or contract in unison and ensure the upper work surface platform stays predominantly level or parallel to a surface the height adjustable desktop rests on as the height adjustable desktop raises or lowers.

20. The method of claim 1, wherein the control signals account for the first and second data regarding the current positions of the first and second actuators such that the first and second actuators extend or contract in unison and ensure the upper work surface platform stays predominantly level or parallel to a surface the height adjustable desktop rests on as the height adjustable desktop raises or lowers.

* * * * *